US005472192A

United States Patent [19]

Eto

[11] Patent Number: 5,472,192

[45] Date of Patent: Dec. 5, 1995

[54] RACING GAME APPARATUS

[75] Inventor: Tetsutaro Eto, Tokyo, Japan

[73] Assignee: Eto Denki Co., Tokyo, Japan

[21] Appl. No.: 219,796

[22] Filed: Mar. 29, 1994

[30] Foreign Application Priority Data

Mar. 29, 1993 [JP] Japan ..... 5-70420

[51] Int. Cl.[6] ..... A63F 9/14

[52] U.S. Cl. ..... 273/86 B

[58] Field of Search ..... 273/86 R, 86 B

[56] References Cited

U.S. PATENT DOCUMENTS

| | | | |
|---|---|---|---|
| 2,180,448 | 11/1939 | Williams | 273/86 B |
| 2,358,604 | 9/1944 | Stewart | 273/86 B X |
| 2,687,889 | 8/1954 | Wiltshire | 273/86 R |
| 2,827,296 | 3/1958 | Walker | 273/86 B |
| 3,377,958 | 4/1968 | Bax et al. | 273/86 B X |
| 3,630,524 | 12/1971 | Cooper et al. | 273/86 R |
| 3,961,791 | 6/1976 | Etchegoyhen | 273/86 B |
| 4,844,462 | 7/1989 | Lubniewski | 273/86 B |

FOREIGN PATENT DOCUMENTS 1-259404 10/1989 Japan .

*Primary Examiner*—William H. Grieb
*Attorney, Agent, or Firm*—Foley & Lardner

[57] ABSTRACT

A racing game apparatus comprises a track plate 8, running members 9 adapted to run on the track plate 8, running wheels 13, sprockets 28 and 29, models K, and an arithmetic control circuit 80. The track plate 8 has a guide means in which longitudinal racks and lateral racks are crossed in longitudinal and lateral directions. The running wheels 13 provided to the running members 9 each have a plurality of engagement tooth portions 13 engaged with the longitudinal racks 10 and are rotated and driven by a first motor 14. The sprockets 28 and 29 mounted on the running members 9 are engaged with the lateral racks **10*b* and are rotated and driven by a second motor 17. The models K are disposed above the running members 9 and moved in association with the running members 9. The arithmetic control circuit 80 is mounted on the running members 9** and adapted to drive and control the first and second motors.

11 Claims, 11 Drawing Sheets

RACING GAME APPARATUS

BACKGROUND OF THE INVENTION

1. Field of the Invention

The present invention relates to a racing game apparatus for racing a plurality of models.

2. Description of the Prior Art

Racing games are installed in game centers. For example, such a car racing game apparatus is known as in Japanese Patent Laid-Open Publication No. Hei 1-259404.

In the car racing game, running members are disposed on a track. Car models are incorporated with the running members so that the car models are moved along with the running members. Position detection plates that detect the positions of the running members are disposed below the track. The positions of the running members are always detected corresponding to output signals of the position detection plates. Based on the detected signals, a control circuit controls the running of the running members on a feedback control system.

However, when the running of the running members is controlled on the feedback control system, the construction of the control circuit will become complicated and thereby the cost of the final product will rise.

SUMMARY OF THE INVENTION

An object of the present invention is to provide a racing game apparatus that can accurately control the running of racing models at a low cost without need to perform a feedback control.

To accomplish the object, a racing game apparatus comprises a track plate having a guide means in which a plurality of longitudinal racks and a plurality of lateral racks are crossed in longitudinal and lateral directions; a running member adapted to run on the track plate; running wheels each having a plurality of engagement tooth portions engaged with the longitudinal racks, rotated and driven by a first motor, and disposed on the running member; a sprocket engaged with the lateral racks, rotated and driven by a second motor, and disposed on the running member; a power feeder unit adapted to supply electric power to the first and second motors; a model disposed above the running member and moved in association with the running member; and an arithmetic control circuit disposed on the running member and adapted to drive and control the first and second motors.

The invention is also characterized in that the power feeder unit comprises a plurality of primary coils disposed along and below a running-member-disposed surface of the track plate and a plurality of secondary coils disposed on the running member.

The invention further characterized in that the primary coils are disposed in parallel along the running-member-disposed surface.

Another aspect of the invention is characterized in that one of two adjacent coils of the primary coils receives an alternate current opposite in phase to an alternate current received by the other of the adjacent coils from an alternate current source through a phase control circuit.

Yet another aspect of the invention is characterized in that each of the secondary coils has a first coil, a second coil, and a third coil, the first coil and the second coil being wound around axes in parallel with the running-member-disposed surface and perpendicular to each other, the third coil being wound around an axis aloha the running-member-disposed surface.

The invention is also characterized in that the arithmetic control circuit is adapted to receive control information from a controller through radio communication means.

The invention is further characterized in that the radio communication means comprises information receiving means disposed on the running member and connected to the arithmetic control circuit and information transmitting means disposed above the track plate and adjacent to a peripheral portion thereof.

The invention is characterized in that the information receiving means is a light receiving device and the information transmitting means is a light emitting device.

Another aspect of the invention is characterized in that a surface plate is disposed above the track plate with a space, the model being disposed on the surface plate so as to be moved by a masher disposed at least on one of the running member and the model in association with the running member, the space formed by the track plate and the surface plate being closed by a side wall of the peripheral portion, the light emitting device being disposed between the running member and the surface plate.

BRIEF DESCRIPTION OF THE DRAWINGS

FIG. 1(*b*) is a schematic explanatory bottom view showing a layout of a coil assembly disposed in the running member of FIG. 1 (*a*).

FIG. 2(*b*) is an explanatory view showing another example of a primary coil and a magnetic conductor disposed on the track plate of FIG. 1(*a*).

FIG. 6 (*b*) is a schematic plan view showing another example of the track plate shown in FIG. 1(*a*).

DETAILED DESCRIPTION OF THE PREFERRED EMBODIMENT

The embodiment of the present invention will be described hereinafter with reference to the accompanying drawings.

Figure 1A:
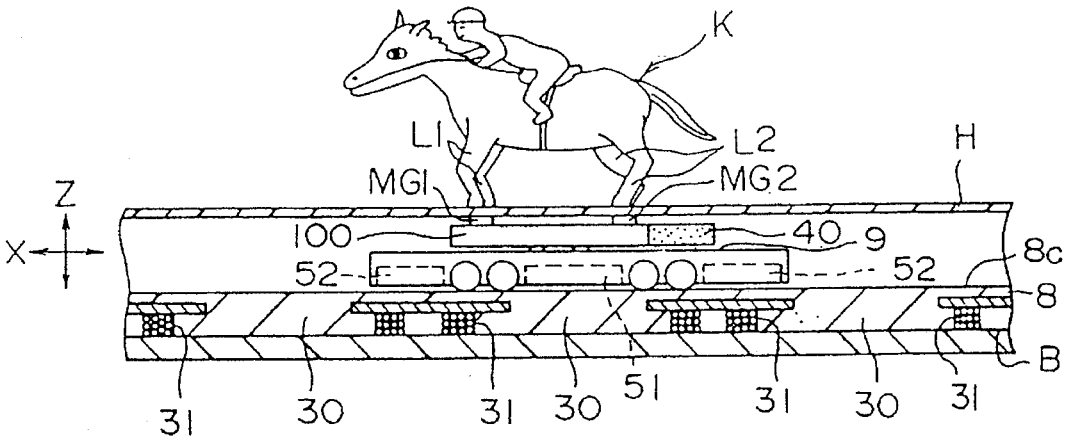
FIG. 1(*a* ) is a schematic sectional view showing a game apparatus having a power feeder unit that supplies electric power to a racing-member-side electric drive means according to the present invention.
Figure 1B:
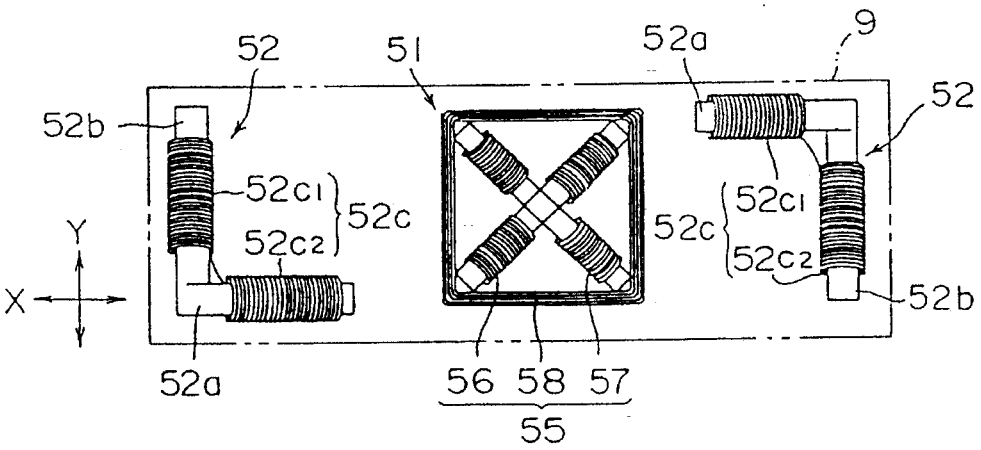

FIGS. 1(*a*) to 13 show the embodiment of the present invention.

In FIG. 1(*a*), a track plate 8 is disposed on a base B. The track plate 8 is made of resin. A running member 9 is disposed on the track plate 8. The running member 9 is provided with a leg drive unit 100. A surface plate H is disposed on the leg drive unit 100. The surface plate H is made of resin. A horse model K is disposed on the surface plate H. Magnets (not shown) disposed at lower end portions of front legs L1 and rear legs L2 of the horse model K are magnetically connected to magnets MG1 and MG2 disposed on the leg drive unit 100 through the surface plate H so that the horse model is slidably moved on the surface plate H along with the running member 9.

Mechanical Construction of Track Plate Side

Figure 6B:
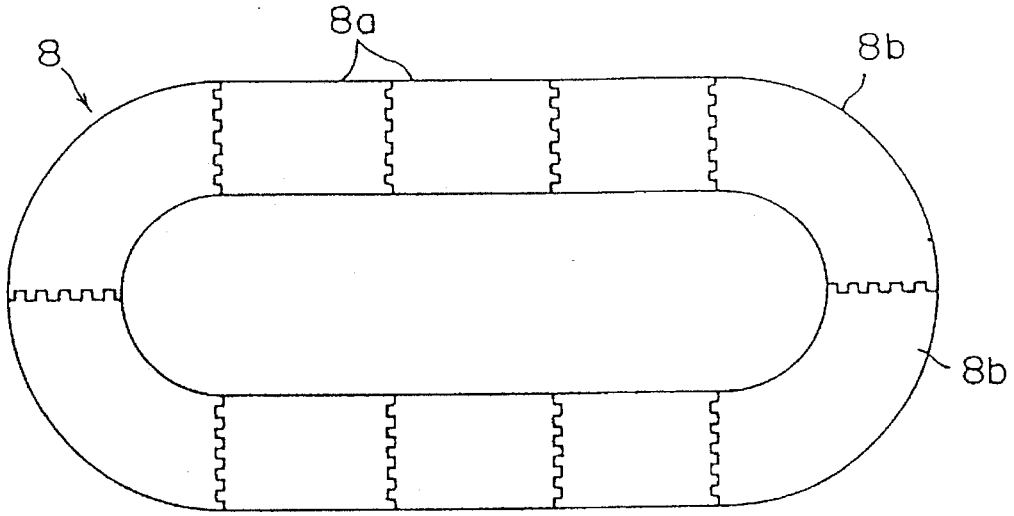
FIG. 6 (*a*) is a plan view showing the track plate shown in FIG. 1(*a*).
Figure 6A:
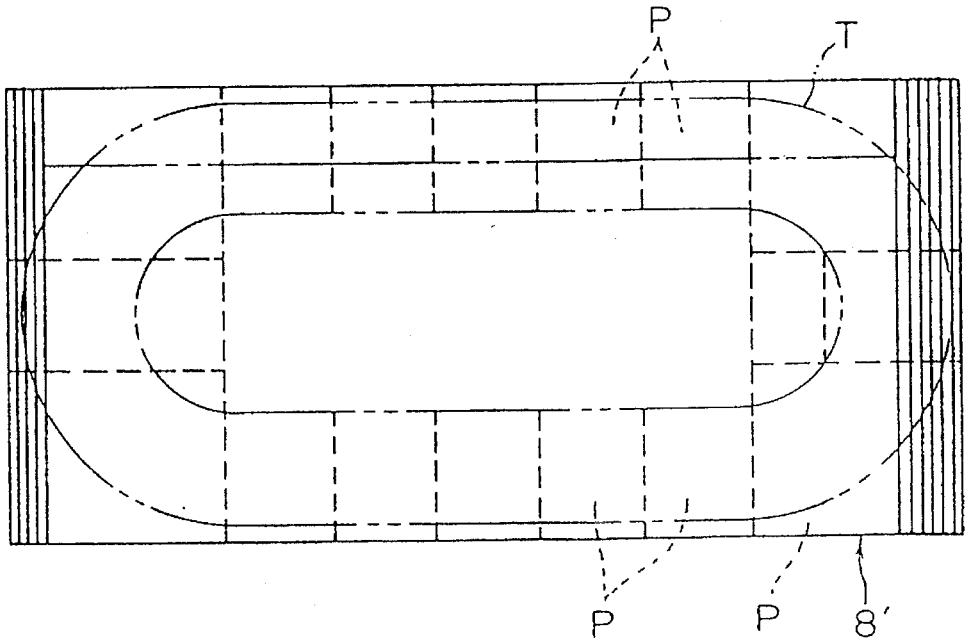
Figure 7:
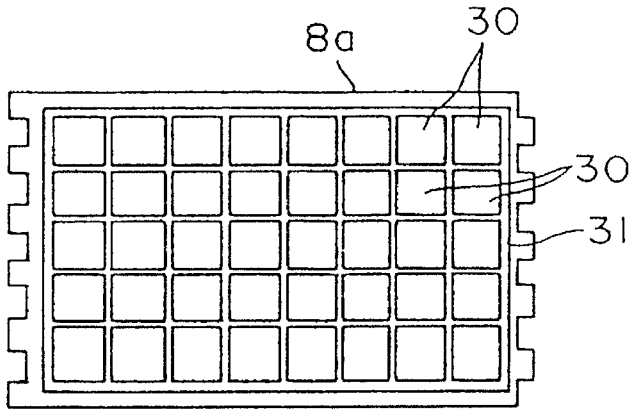
FIG. 7 is a bottom view showing a straight panel constructing the track plate shown in FIG. 6(*a*).
Figure 8:
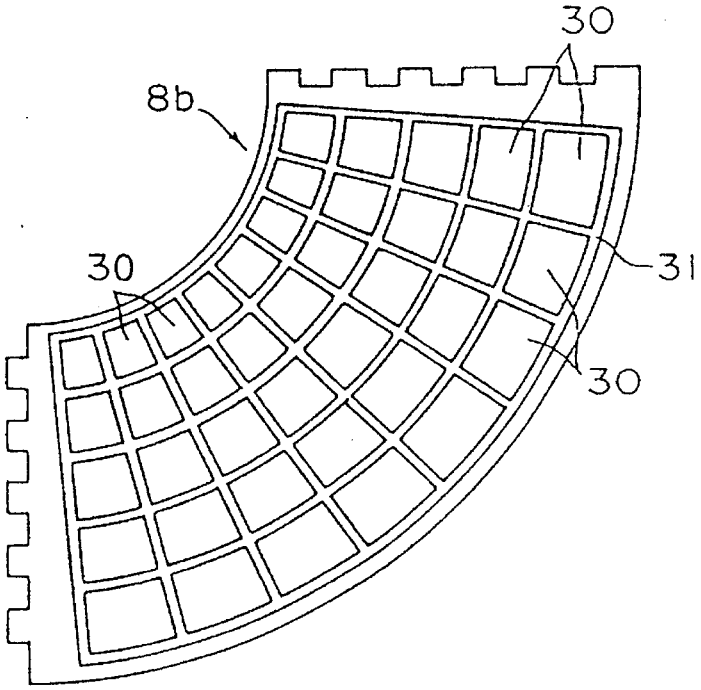
FIG. 8 is a bottom view showing a sector-shaped panel constructing the track plate shown in FIG. 6(*a*).

As shown in FIG. 6(*a*), the track plate 8 is constructed of a plurality of straight panels 8*a* (see FIG. 7) and a plurality of sector-shaped panels 8*b* (see FIG. 8). The upper surface of the track plate 8 is a running-member-disposed surface 8*c* (track surface) on which the running member 9 is disposed. A guide means 12 is formed on the track plate 8. The guide means 12 is constructed of a plurality of longitudinal racks 10 and a plurality of lateral racks 10*a*.

Each longitudinal rack 10 is constructed of a plurality of lateral racks 10*a* disposed at equal pitches in a main running direction of the running member 9. Each of the lateral racks 10*a* is constructed of a plurality of rack teeth lob disposed at equal pitches in an elongate direction. Reference numeral 11*a* is an engagement groove defined between the rack teeth 10*b* and 10*b*. The height of the bottom surface of the engagement groove 11*a* is slightly larger than the height of the other portion of the track plate 8.

Side walls 10*c* of the rack teeth lob of the lateral racks 10*a* are not always perpendicular to an alignment direction of the rack teeth lob. For example, the side walls 10*c* may be defined in a curved shape similar to the tooth wall shape in the alignment direction of the lateral racks 10*a*. In other words, the side walls 10*c* may be defined in the tooth wall shape of an involute curve.

As shown in FIGS. 1(*a*), 2(*a*), 7, and 8, a large number of protrusions 30 and grooves 31 are formed on the lower surfaces of the straight panels 8*a* and the sector-shaped panels 8*b* of the track plate 8. The grooves 31 are disposed in a mesh shape. As shown in FIGS. 1(*a*) and 2(*a*), primary coils 33 and 34 that are stationary-side power feeder sources are alternately disposed in the grooves 31 along the track surface 8*c*.

Figure 2A:
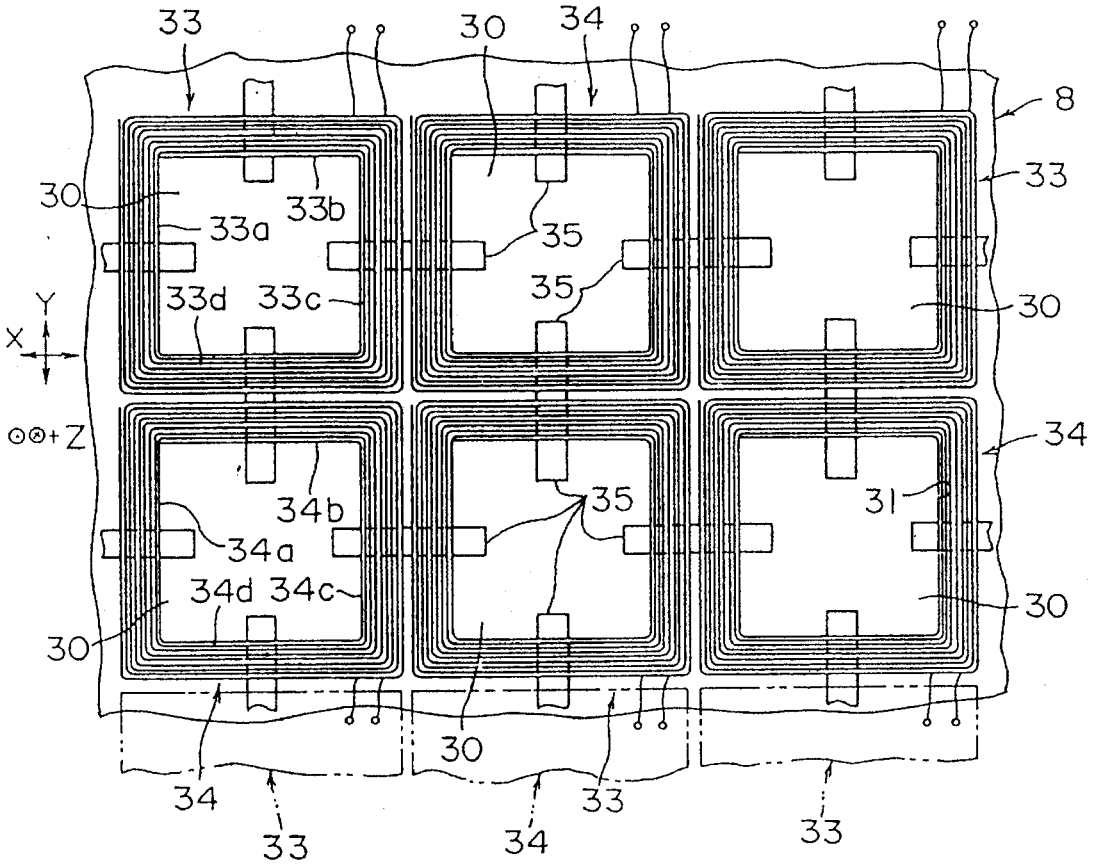
FIG. 2(*a*) is a partial bottom view showing a track plate shown in FIG. 1(*a*).
Figure 2B:
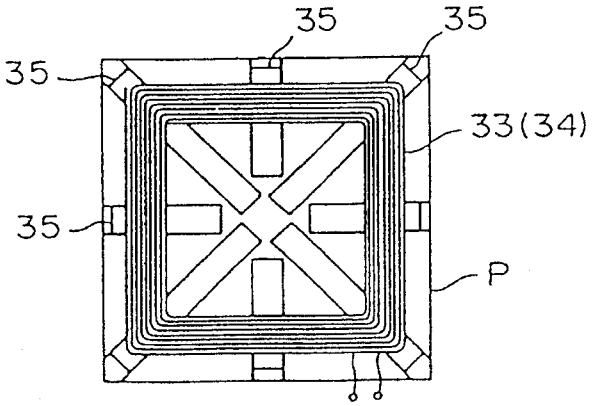
Figure 3:
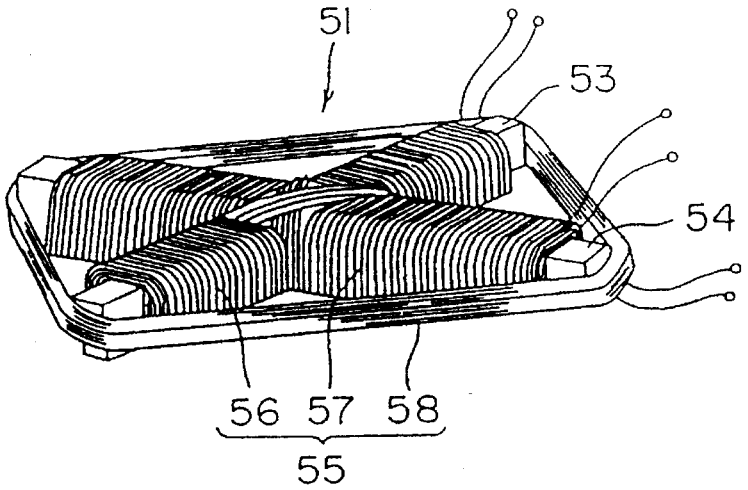
FIG. 3 is a perspective explanatory view showing principal portions of a power receiving means of FIG. 1(*b*).

The primary coil 33 is formed of sides 33*a*, 33*b*, 33*c*, and 33*d* nearly in a square shape. Likewise, the primary coil 34 is formed of sides 34*a*, 34*b*, 34*c*, and 34*d* nearly in the same shape as the primary coil 33. Magnetic conductors 35 are disposed on the panels 8*a* and 8*b* so that they are perpendicular to the sides 33*a*, 34*a*, 33*b*, 34*b*, 33*c*, 34*c*, 33*d*, and 34*d*. The magnetic conductors 35 are buried in the panels 8*a* and 8*b* by an insert molding method. The magnetic conductors 35 are made of a magnetic conductive material such as ferrite. In practice, as shown in FIG. 2(*b*), magnetic conductors 35 are additionally disposed in diagonal directions of the primary coils 33 and 34. In this construction, the magnetic resistance in the diagonal directions is lower than the magnetic resistance in the other directions so that the intensity of magnetic field to be obtained becomes strong.

In this embodiment, the track plate 8 is constructed of a plurality of panels that are connected in a track shape. However, the present invention is not limited to such a construction. Instead, as shown in FIG. 6(*b*), the track plate 8 may be formed of one flat plate. In addition, as shown in FIG. 6(*b*), a panel P on which the primary coils 33 or 34 and the magnetic conductors 35 as shown in FIG. 2(*b*) are disposed may be disposed below the track plate 8 along the track T.

Mechanical Construction of Running Member Side

The running member 9 comprises a running member main body 9*a*, running wheels 13, a motor 14 (electric drive portion), a reduction gear portion 15 (not shown), sprockets 28 and 29, a motor 17 (electric drive portion), and a reduction gear portion 18. The running wheels 13 are disposed on both sides of the running member main body 9*a*. The running wheels 13 are engaged with the longitudinal racks 10 so as to move the running member main body 9*a* in the alignment direction of the longitudinal racks 10. The motor 14 and the reduction gear portion 15 serve as a means for driving the running wheels 13. The sprockets 28 and 29 are engaged with the lateral racks 10*a* so as to move the running member main body 9*a* in the alignment direction of the lateral racks 10*a*. The motor 17 and the reduction gear portion 18 serve as a means for driving the sprockets 28 and 29. The motors 14 and 17 are pulse motors.

The running member main body 9*a* is constructed of a front wall 9*b*, a rear wall 9*c*, a mounting member 9*g*, a left side wall 9*d*, and a right side wall me. The front wall 9*b*, the rear wall 9*c*, and the mounting member 9*g* are nipped by the left and right side walls 9*d* and 9*e* so that an outer frame with upper and lower open ends is formed.

A front running module M1 is disposed at a front half portion of the running member main body 9*a*. A rear running module M2 is disposed at a rear half portion of the running member main body 9*a*. The construction of the front running module M1 is almost the same as the construction of the rear running module M2.

Two rotating shafts 19 and 19 extend from the side walls 9*d* and 9*e* of each of the front and rear running modules M1 and M2 and are spaced apart by a predetermined length.

The running wheel 13 and a follower gear 20 are rotatably disposed on the rotating shaft 19. The follower gear 20 is secured to the running wheel 13. A part of the front running module M1 is constructed of two pairs of the left and right running wheels 13 and the drive means. A part of the rear running module M2 is constructed of two pairs of the left and right running wheels 13 and the drive means.

First of all, the front running module M1 will be described. Engagement grooves 13*a* are formed at pitches of 90° on peripheral portions of the left and right running wheels 13 and 13 of the front running module M1. The engagement grooves 13*a* are engaged with the engagement protrusions 10*a* on the track plate 8, thereby forming an engagement tooth portion 13*b*.

Barrel-shaped bearings 21 are disposed at the engagement tooth portion 13*b*. The barrel-shaped bearings 21 are rotated about respective pins 21*a* that extend in respective arc directions of the running wheel 13. The height of the outer periphery of the barrel-shaped bearing 21 is slightly larger than the height of the periphery of the running wheel 13. The curvature of each barrel-shaped bearing 21 is nearly the same. The rotating direction of the barrel-shaped bearing 21 is perpendicular to the rotating direction of the running wheel 13.

The motor 14, which works as the drive means, is secured to the right side wall 9*e* through the mounting member 9*f*. A pinion gear 22 is disposed on a motor shaft of the motor 14. The pinion gear 22 is engaged with a reduction gear 24 that rotates and drives a drive shaft 23.

Figure 10:
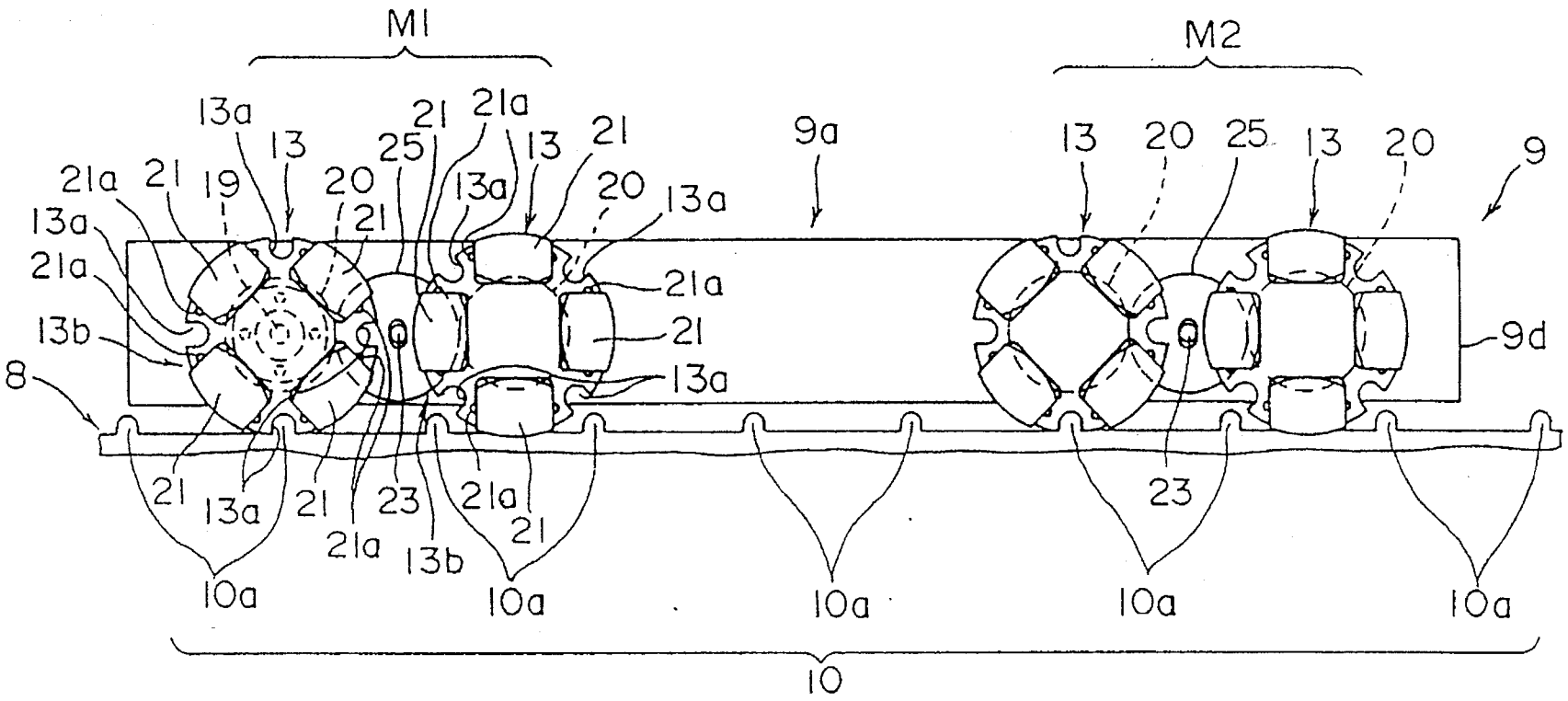
FIG. 10 is a side view of principal portions showing the relation between the track plate and running wheels according to the embodiment of the present invention.

Follower gears 20 and 20 and a drive gear 25 are disposed at an end portion of the drive shaft 23. The follower gears 20 and 20 are engaged with the drive gear 25. Thus, the rotation of the drive shaft 23 is transmitted to the running wheel 13. As shown in FIG. 10, the follower gears 20 and 20 of each of the front and rear running modules M1 and M2 are engaged with the drive gear 25 in such a way that the phase of one follower gear 20 differs from the phase of the other follower gear 20 by 45°.

Thus, one set of the front and rear running wheels 13 and 13 of the front running module M1 are rotated and driven by the drive gears 25 so that when the engagement tooth portion 13*b* of one running wheel 13 is engaged with the longitudinal rack 10, one of the barrel-shaped bearings 21 of the other running wheel 13 is in contact with the track plate 8.

Figure 12:
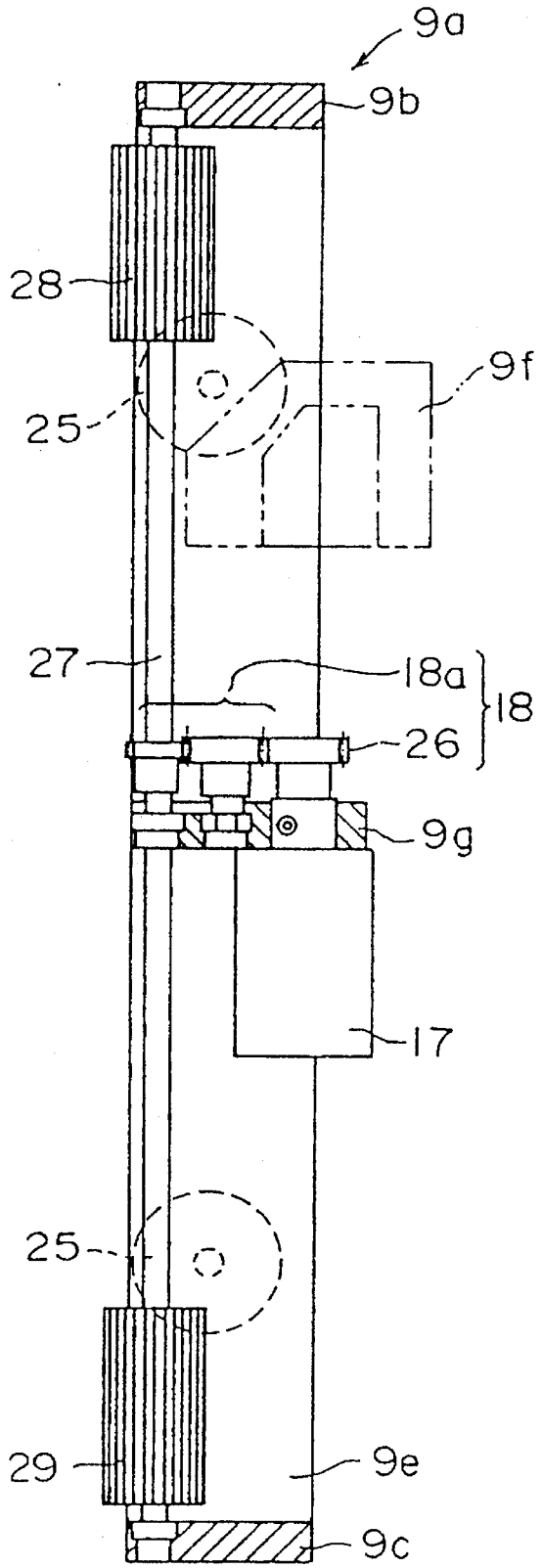
FIG. 12 is a sectional view, taken along line A—A of FIG. 9, showing a sprocket drive mechanism of the running member according to the embodiment of the present invention.
Figure 13:
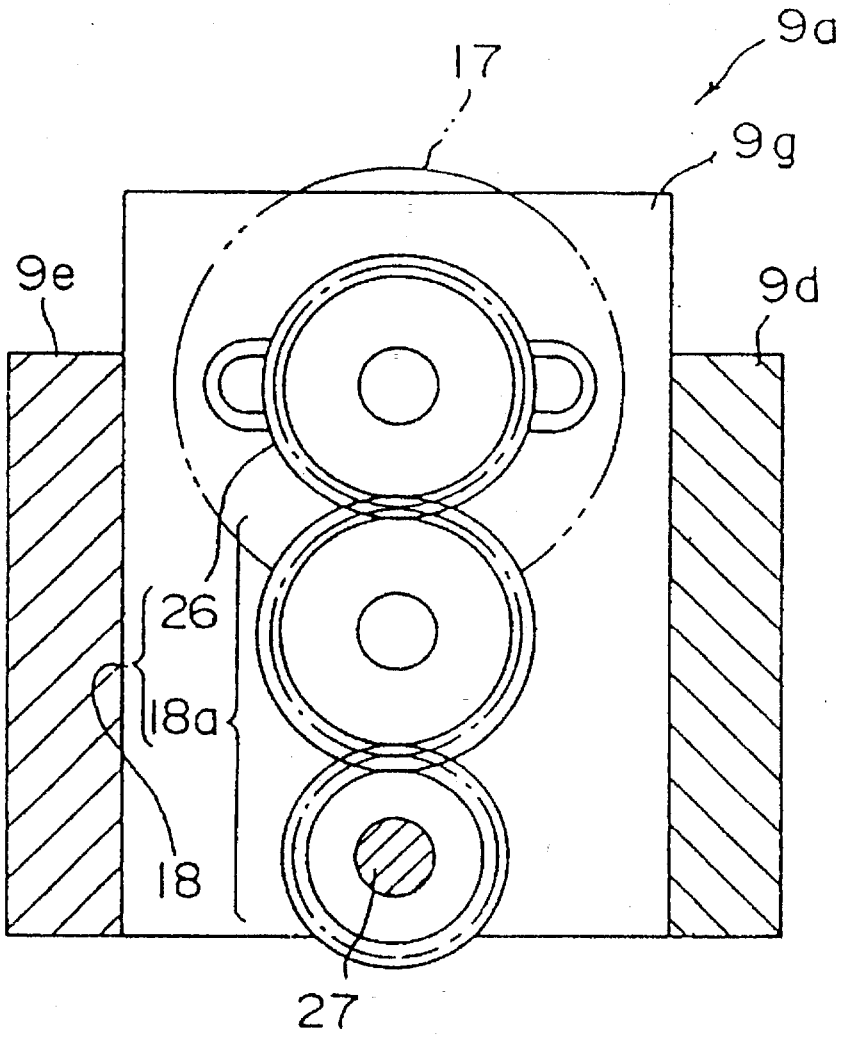
FIG. 13 is a sectional view, taken along line B—B of FIG. 11, showing a reduction gear portion of the running member according to the embodiment of the present invention.

In addition, as shown in FIG. 12, in the middle of the running member main body 9*a*, a motor case of the motor 17, which works as the drive means is secured to the mounting member 9*g*. A pinion gear 26 is disposed on a motor shaft of the motor 17. The pinion gear 26 and a reduction gear train 18*a* construct the reduction gear portion 18. A rotating shaft 27 is disposed between the front and rear walls 9*b* and 9*c*. The rotating shaft 27 is rotatably pivoted between the front and rear walls 9*b* and 9*c*. The rotation of the pinion gear 26 is transmitted to the rotating shaft 27 through the reduction gear train 18*a*.

Sprockets 28 and 29 are disposed at front and rear end positions of the rotating shaft 27, respectively. The sprockets 28 and 29 are engaged with the lateral racks 10*a* on the track plate 8. Thus, as the rotating shaft 27 is rotated, the running member main body 9*a* is moved in the alignment direction of the lateral racks 10*a*.

The lengths of the sprockets 28 and 29 are slightly larger than the distance between the adjacent longitudinal racks 10 and 10 on the track plate 8.

The rotations of the motors 14 and 17 are controlled by a controller (not shown) that includes a power supply.

Figure 9:
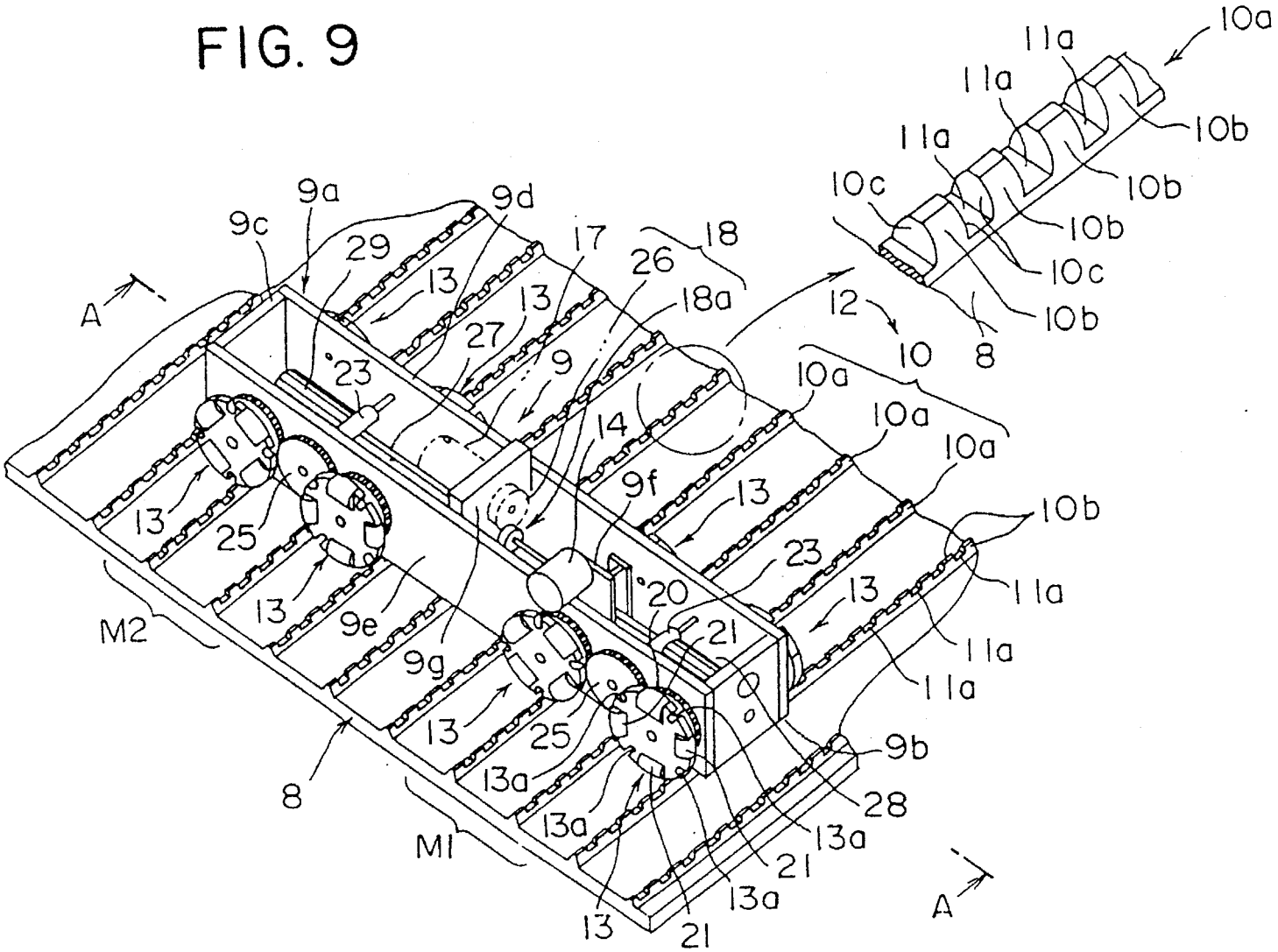
FIG. 9 is an overall perspective view showing that the running member according to an embodiment of the present invention is running on the track plate.
Figure 11:
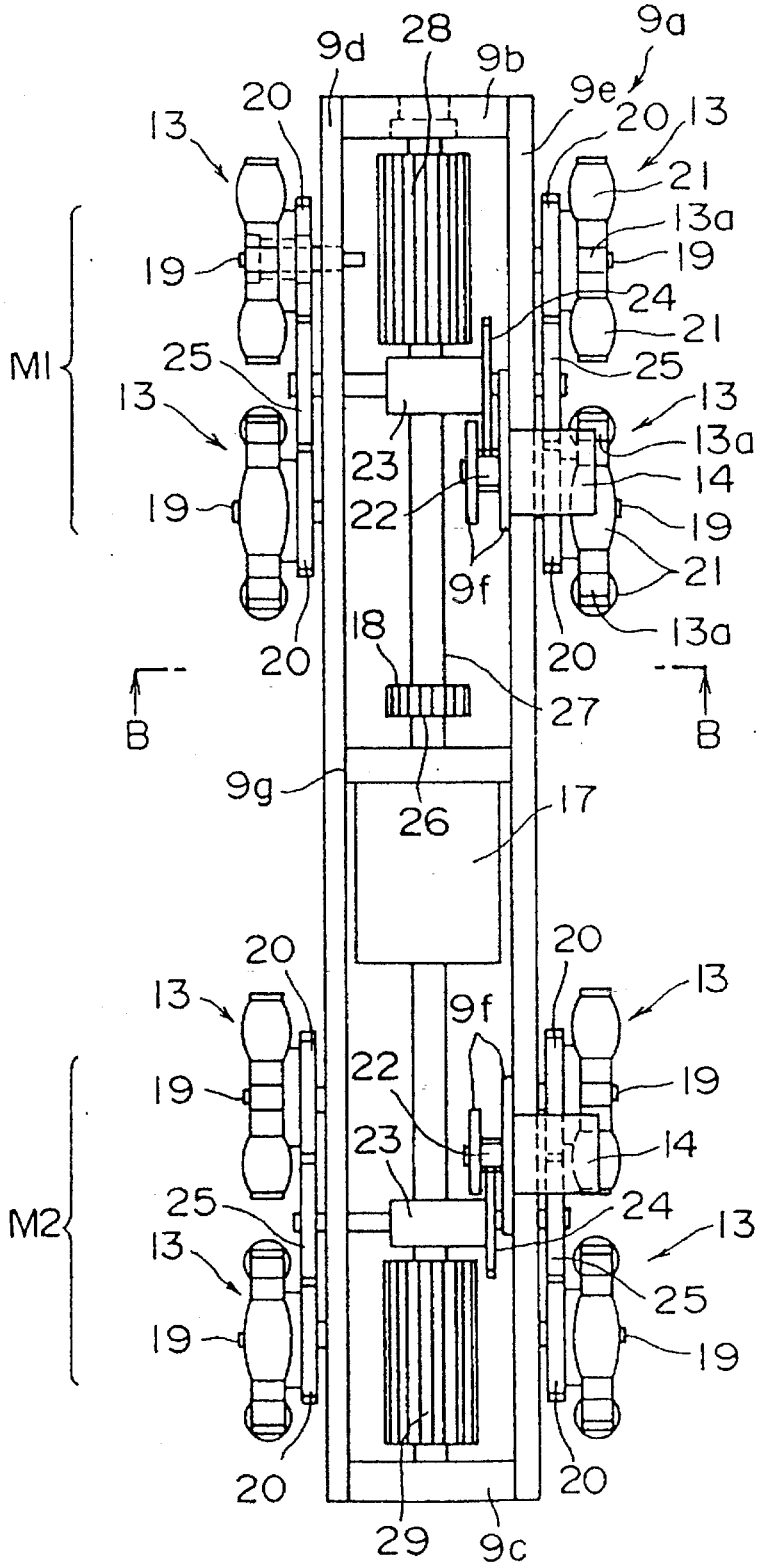
FIG. 11 is a top plan view showing the running member according to the embodiment of the present invention.

The construction of the rear running module M2 is nearly the same as the construction of the front running module M1. For simplicity, the same portions as the front running modules M1 are denoted by the same reference numerals and a description of them is omitted (see FIGS. 9 to 11).

As shown in FIG. 1(*a*), the running member 9 is provided with a battery 40 that works as an auxiliary power supply. In addition, the running member 9 has a movable electric power receiving unit 50 that receives electric power from the primary coils 33 and 34 (stationary-side power feeder sources).

The electric power receiving unit 50 has a first coil assembly 51 and a pair of second coil assemblies 52. The first coil assembly 51 is disposed at center of the running member 9. The second coil assemblies 52 are disposed at front and rear ends (in a longitudinal direction) of the running member 9. As shown in FIGS. 1 (*b*) and 3, the coil assembly 51 is constructed of first and second magnetic conductors 53 and 54 and a secondary coil 55 (electric power receiving means). The first and second magnetic conductors 53 and 54 are made of a magnetic conductive material such as ferrite. The second coil 55 (electric power receiving means) receives electric power from the primary coils 33 and 34 (stationary-side power feeder sources). The magnetic conductors 53 and 54 are secured to each other so that the magnetic conductor 53 is perpendicular to the magnetic conductor 54. The axial lines of the magnetic conductors 53 and 54 are in parallel with the running-member-disposed surface 8*a* of the track plate 8. In FIG. 2, it is assumed that the left-right direction, up-down direction, and direction perpendicular to the drawing are referred to as X, Y, and Z directions, respectively. The magnetic conductors 53 and 54 are oriented by 45° with respect to the X and Y directions.

The secondary coil 55 is constructed of a first coil 56, a second coil 57, and a third coil 58. The first and second coils 56 and 57 are wound around the first and second magnetic conductors 53 and 54, respectively. The third coil 58 is wound around end surfaces of the first and second magnetic conductors 53 and 54 along the running-member-disposed surface 8*a*.

As shown in FIG. 1(*b*), the second coil assembly 52 is constructed of a first magnetic conductor 52*a*, a second magnetic conductor 52*b*, and a secondary coil 52*c* (electric power receiving means). The first and second magnetic conductors 52*a* and 52*b* are made of a magnetic conductive material such as ferrite. The first and second magnetic conductors 52*a* and 52*b* are secured to each other so that the first magnetic conductor 52*a* is perpendicular to the second magnetic conductor 52*b*. The axial lines of the first and second magnetic conductors 52*a* and 52*b* are disposed in parallel with the running-member-disposed surface 8*a* of the track plate 8. The secondary coil 52*c* is constructed of a first coil 52*c*1 and a second coil 52*c*2.

The first and second coils 52*c*1 and 52*c*2 are wound around the first and second magnetic conductors 52*a* and 52*b*, respectively.

Power Feeder Circuit

Figure 4:
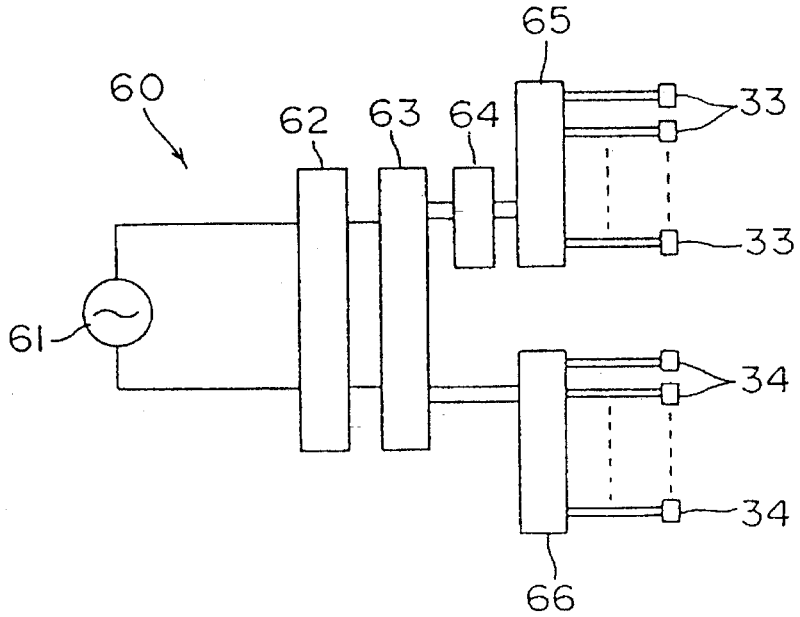
FIG. 4 is an explanatory view showing a stationary-side power feeder circuit having a primary coil shown in FIG. 1(*a*).
Figure 5:
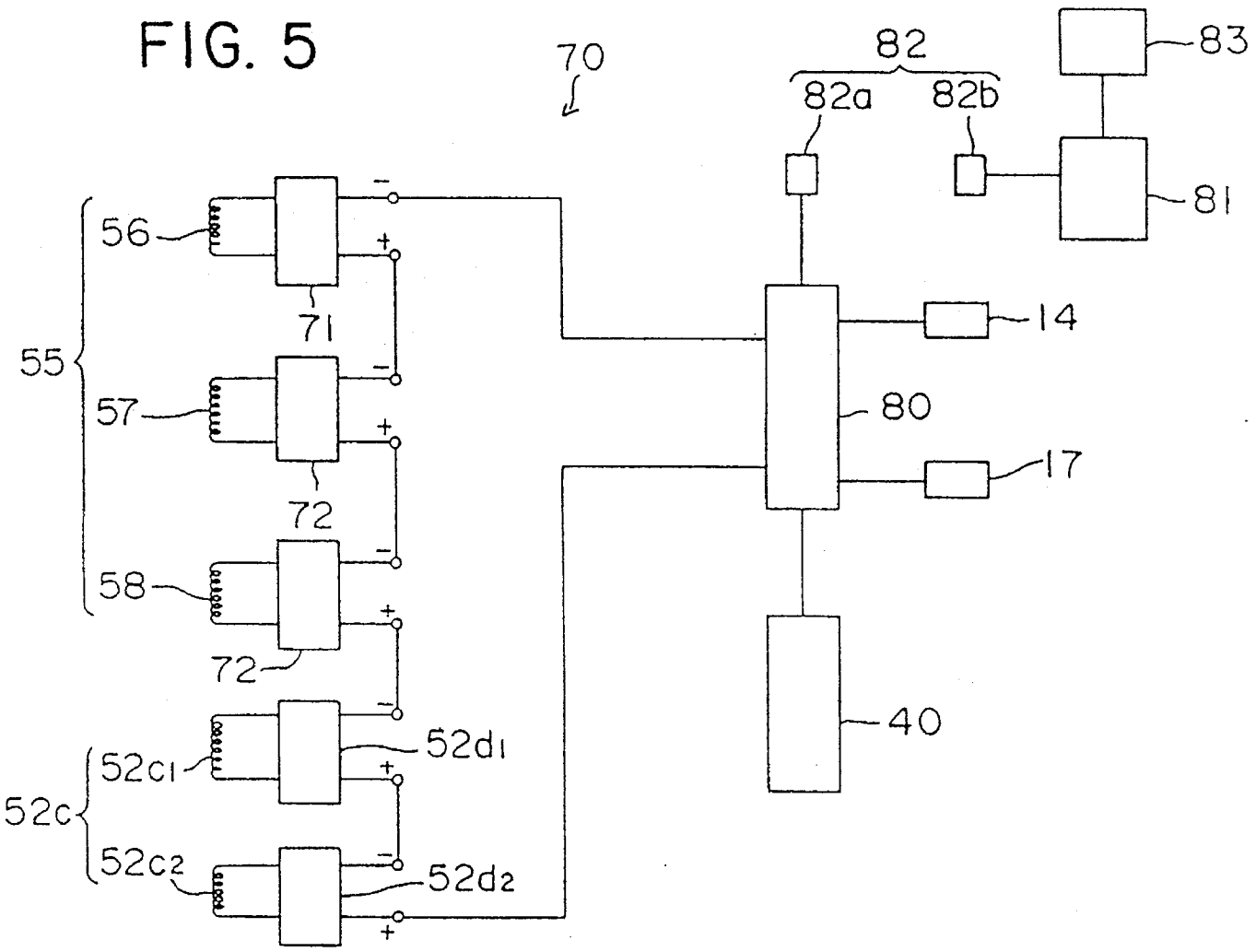
FIG. 5 is an explanatory view showing a running-member side power feeder circuit having a secondary coil shown in FIG. 3.

A power feeder circuit is constructed of a stationary-side circuit 60 shown in FIG. 4 and a moving-side circuit 70 shown in FIG. 5. The stationary-side circuit 60 is disposed on the base B. The moving-side circuit 70 is disposed on the running member 9.

The stationary-side circuit 60 comprises a power supply circuit 62, a frequency modulating circuit 63, a phase control circuit 64, a power distributor 65, and a distributor 66. The power supply circuit 62 is connected to a commercial power supply 61 (AC power supply). The frequency modulating circuit 63 modulates a frequency of an alternate current received from the power supply circuit 62 into a high frequency. The phase control circuit 64 controls the phase of output voltage/current of the frequency modulating circuit 63. The power distributor 65 distributes the power supplied from the phase control circuit 64 to a plurality of primary coils 33. The distributor 66 distributes the electric power supplied from the frequency modulating circuit 63 to the primary coil 34.

The frequency modulating circuit 63 outputs an alternate current with a frequency ranging from 10 kHz to 30 kHz. Each of the primary coils 33 and 34 supplies electric power of around 30 W to the power supply circuit 62 and the modulating circuit The phase control circuit 65 serves to reverse the phase of an alternate current supplied to the primary coil 33 with respect to the phase of an alternate current supplied to the primary coil 34. Thus, one of two adjacent coils of the primary coils receives an alternate current opposite in phase to an alternate current received by the other of the adjacent coils from an alternate current source.

As shown in FIG. 5, the moving-side circuit 70 comprises the coils **52*c*1, 52*c*2, 56, 57, and 58, rectifier circuits 52*d*1, 52*d*2, 71, 72, and 73, and an arithmetic control circuit 80. The rectifier circuits 52*d*1, 52*d*2, 71, 72, and 73 are connected to the coils 52*c*1, 52*c*2, 56, 57, and 58, respectively. The outputs of the coils 52*c*1, 52*c*2, 56, 57, and 58 are connected in series. The arithmetic control circuit 80 operates with direct currents supplied from the rectifier circuits 52*d*1, 52*d*2, 71, 72, and 73 and controls pulses supplied to the motors 14 and 17**.

In this embodiment, the rectifier circuits **52*d*1, 52*d*2, 71, 72 and 73 are connected in series so that a constant current and a constant voltage are obtained even if the current and voltage of one of the coils 52*c*1, 52*c*2, 56, 57, and 58 are lowered corresponding to the position of the running member and thereby the voltage and current of one of the rectifier circuits 52*d*1, 52*d*2, 71, 72, and 73 are lowered. However, the present invention is not limited to such a construction. Instead, as long as such a condition is satisfied, the rectifier circuits 52*d*1, 52*d*2, 71, 72, and 73** may be connected in parallel.

The arithmetic control circuit 80 always receives control information from a controller 81 that has a CPU through an optical communication means (radio communication means). The controller 81 generates control information corresponding to data entered from a control panel 83. The optical communication means 82 has a light receiving device **82*a* (not shown) and a light emitting device 82*b* (not shown). The light receiving device 82*a* works as an information receiving means. The light receiving device 82*a* is connected to an input of the arithmetic control circuit 80 and is disposed on the running member 9. The light emitting device 82*b* works as an information transmitting means. The light emitting device 82*b* is connected to an output of the controller 81 and is positioned between the track plate 8 and the surface plate H. The light emitting device 82*b* is disposed on the base B. A side wall (not shown) is disposed between the surface plate H and a peripheral portion of the track plate 8. A space defined between the surface plate H and the track plate 8 is closed. The light emitting device 82*b* may be disposed on the peripheral portion of the track plate or an inner surface of the side wall (not shown), which closes the surface plate H and the peripheral portion of the track plate 8. The light emitting device 82*b* irradiates infrared rays or the like. The light receiving device 82*a*** receives the infrared rays or the like.

While the running member 9 is running at a position where the voltage applied by the rectifier circuits **52*d*1, 52*d*2, 71, 72, and 73 is high, the arithmetic control circuit 80 causes part of electric power supplied from the rectifier circuits 52*d*1, 52*d*2, 71, 72, and 73 to the battery 40. On the other hand, while the running member 9 is running at a position where the voltage applied by the rectifier circuits 52*d*1, 52*d*2, 71, 72, and 73 is low, the arithmetic control circuit 80 causes the battery 40 to supply electric power so as to drive and control the motors 14 and 17**.

Operation of the Embodiment

Next, the operation of the embodiment will be described.

Power Supply

When the running member 9 is run, the electric power of a commercial power supply 61 is supplied to the adjacent primary coils 33 and 34 through the stationary-side circuit 60. The phase of an alternate current supplied from the phase control circuit 65 to the primary coil 33 is the inverse of the phase of the alternate current supplied from the phase control circuit 65 to the primary coil 34. Thus, the orientations (directions of vectors) of the magnetic fluxes that take place at the adjacent portion of the primary coils 33 and 34 are the same, thereby strengthening the magnetic fluxes each other, rather than offsetting them.

The primary coils 33 and 34 each generate vector components of magnetic fluxes in X, Y, and Z directions.

The first coil 56 of the first, second, and third coils 56, 57, and 58 of the secondary coil 55 is exposed to vector changes of magnetic fluxes in the X and Y directions, thereby inducing an AC electromotive force. The second coil 57 is exposed to vector changes of the magnetic fluxes in the X and Y directions of the primary coils 33 and 34, thereby inducing an AC electromotive force. The third coil 58 is exposed to vector changes of magnetic fluxes in the Z direction of the primary coils 33 and 34, thereby inducing an AC electromotive force. The coil **52*c*1 is exposed to vector changes of magnetic fluxes in the X directions of the primary coils 33 and 34, thereby inducing an AC electromotive force. The coil 52*c*2 is exposed to vector changes of magnetic fluxes in the Y directions of the primary coils 33 and 34**, thereby inducing an AC electromotive force.

The alternate currents induced in the coils **52*c*1, 52*c*2, 56, 57, and 58 are converted into direct currents through the rectifiers 52*d*1, 52*d*2, 70, 71, and 72, respectively. The direct currents output from the rectifiers 52*d*1, 52*d*2, 70, 71, and 72 are combined and supplied to the arithmetic control circuit 80**.

Thus, the combined current, where the outputs of the rectifiers **52*d*1, 52*d*2, 70, 71, and 72 are combined, is kept in a constant level regardless of whether the coil assembly 51 is positioned at an upper center position of each of the primary coils 33 and 34 or an adjacent position thereof. In other words, the combined current is always kept in a constant level regardless of the position of the coil assembly 51. Thus, while the running member 9 is running, the electric power is supplied to the arithmetic control circuit 80** without need to use contacts.

While the running member 9 is running at a position where the voltage supplied from the rectifier circuits **52*d*1, 52*d*2, 71, 72, and 73 is high, the arithmetic control circuits 80 causes part of electric power supplied from the rectifier circuits 52*d*1, 52*d*2, 71, 72, and 73 to be charged to the battery 40. While the running member 9 is running at a position where the voltage supplied from the rectifier circuits 52*d*1, 52*d*2, 71, 72, and 73 is low, the arithmetic control circuits 80 causes the electric power to be discharged from the battery 40, so as to drive and control the motors 14 and 17**.

Drive of the Running Member 9

When electric powers are supplied from the rectifier circuits **52*d*1, 52*d*2, 70.71, and 72, the arithmetic control circuit 80 supplies drive pulses to the motors 14 and 17**.

When control information of longitudinal running is supplied from the controller 81 to the arithmetic control circuit 80 through the optical communication means 82, the arithmetic control circuit 80 supplies the drive pulses to the motor 14 corresponding to the control information so as to drive and control the motor 14. When the motor 14 is driven, the front and rear running wheels 13 and 13 are rotated in the alignment direction of the longitudinal racks 10 of the track plate 8.

Thus, the engagement grooves 13*a* and 13*a* of the front and rear running wheels 13 and 13 are engaged with the engagement protrusions 10*a* and 10*a*, one by one, thereby moving the running member 9 in the alignment direction of the longitudinal racks 10.

At this point, since one of the engagement grooves 13*a* and 13*a* of the running wheels 13 and 13 is engaged with one of the engagement protrusions 10*a* on the track plate 8, unlike the drive mechanism of the conventional running member, the running member according to the present invention gets never slipped. Thus, the running member 9 can be moved exactly corresponding to the rotations of the running wheels 13.

Consequently, when a stepping motor or the like is used for the motor 14, the rotations of the running wheels are determined corresponding to the number of pulses input to the motor 14 so as to control the running distance. Thus, the running member 9 can be accurately driven to a target position. As a result, since feedback control is not used, sensors or the like that measure the running distance of the running member 9 are not required.

When control information of lateral running is supplied to the arithmetic control circuit 80 from the controller 81 through the optical communication means 82, the arithmetic control circuit 80 supplies drive pulses to the motor 17 corresponding to the control information so as to drive and control the motor 17.

When the motor 17 is driven, the sprockets 28 and 29 are rotated and driven through the pinion sear 26, the reduction sear portion 18*a*, and the rotating shaft 27. Thus, the running member main body 9*a* is moved in the alignment direction of the lateral racks 10*a*.

At this time, while the running wheels 13 and 13 are being rotated, at least one of the barrel-shaped bearings 21 of the running wheels 13 of the front running module M1 and at least one of the barrel-shaped bearings 21 of the running wheels 13 of the rear running module M2 are in contact with the track plate 8. Thus, the moving resistance of the running member 9, which runs in the alignment direction of the longitudinal racks 10, corresponds to the rotating resistance of the barrel-shaped bearings 21. Consequently, the running member 9 can be moved in an oblique direction and a lateral direction with a lower moving resistance than a sliding resistance that takes place between drive wheels and support shafts of the drive mechanism of the conventional running member.

In the moving mechanism of the running member according to the embodiment, the front and rear running modules M1 and N2 are disposed at the front and rear of the running member main body 9*a*. However, the present invention is not limited to such a construction. Instead, one of the running modules M1 and M2 may be disposed on the running member main body 9*a*. In this construction, since at least one of the barrel-shaped bearings 21 of the running wheels 13 is in contact with the track plate 8, the running member 9 can be moved in the oblique direction and the lateral direction with a low moving resistance like the construction where the two barrel-shaped bearings 21 and 21 are in contact with the track plate 8.

In addition, in the moving mechanism of the conventional running member, when the drive wheels move to the end portion of the support shaft and comes in contact with the side wall of the running member, they are prohibited from being moved further in the left and right directions. Thus, the movement of the running member in the lateral direction is limited.

On the other hand, according to this embodiment, since the barrel-shaped bearings 21 are rotated in the alignment direction of the lateral racks 10*a*, the running member 9 can be securely moved in the alignment direction of the lateral racks 10*a* on the track plate 8 without restriction of the running member 9 in the lateral direction.

In the drive mechanism of the running member 9 according to this embodiment, the running member 9 can be smoothly moved in the alignment direction of the lateral racks 10*a*, the energy loss of the motor 17 can be reduced to a minimum level, thereby reducing the size and weight of the drive means.

In addition, a model of a racing horse is disposed on the track surface, which is disposed above the running member 9. The horse model and the running member 9 are attracted by magnetic force so that the horse model is preceded by the running member 9. Thus, the horse model is smoothly moved in forward, backward, oblique, left and right directions on the track surface without restriction of the path. Thus, actions similar to real horse can be created.

In the moving mechanism of the running member according to the embodiment, as the guide means of the track plate 8, the longitudinal racks 10 and the lateral racks 10*a* are formed of rack teeth 10*b*. However, the present invention is not limited to such a construction.

Instead, as long as a plurality of longitudinal racks and a plurality of lateral racks are cross-aligned in the longitudinal and lateral directions, any guide means may be used.

In this case, protrusion-shaped portions should be used instead of the engagement grooves 13*a* of the engagement tooth portions of the running wheels 13.

In the above-described embodiment, although the longitudinal racks 10 and the lateral racks 10*a* are cross-aligned in the longitudinal and lateral directions and the sprockets 28 and 29 are engaged with the lateral racks 10*a*, the running member 9 is moved in the alignment direction of the lateral racks 10*a*. However, without the lateral racks 10*a*, the sprockets 28 and 29, and so forth, the running member 9 may be moved in the alignment direction of the longitudinal racks 10 by another moving means.

In this case, since the running member 9 is supported by the barrel-shaped bearings 13, the running member 9 can be precisely moved in both the alignment direction of the longitudinal racks 10 and the alignment direction of the engagement protrusions 10*a* of the longitudinal racks 10.

As described above, a racing game apparatus according to the present invention comprises a track plate having a plurality of longitudinal racks and a plurality of lateral racks, the longitudinal racks and the lateral racks being cross-aligned in a longitudinal direction and a lateral direction, respectively, a running member adapted to run on the track plate, running wheels each having a plurality of engagement tooth portions engaged with the longitudinal racks, rotated and driven by a first motor, and disposed on the running member, a sprocket engaged with the lateral racks, rotated and driven by a second motor, and disposed on the running member, a power feeder unit adapted to supply an electric power to the first and second motors, a model disposed on the running member and moved in association therewith, and an arithmetic control circuit disposed on the running member and adapted to drive and control the first and second motors.

Thus, the position of the running member can be precisely obtained by the control circuit without need to use a position detection means. Consequently, without necessity of a feedback control, the moving control of the racing model can be precisely and inexpensively performed.

What is claimed is:

1. A racing game apparatus, comprising:

a track plate having a guide means wherein a plurality of longitudinal racks and a plurality of lateral racks are crossed in longitudinal and lateral directions;

a running member adapted to run on said track plate;

running wheels each having a plurality of engagement tooth portions engaged with the longitudinal racks, rotated and driven by a first motor, and provided to said running member;

sprockets engaged with the lateral racks, rotated and driven by a second motor, and disposed on said running member;

a power feeder unit adapted to supply electric power to the first and second motors;

a model disposed above said running member and moved in association with said running member; and an arithmetic control circuit disposed on said running member and adapted to drive and control the first and second motors.

2. The racing game apparatus as set forth in claim 1, wherein said power feeder unit comprises:

a plurality of primary coils disposed along and below a racing-member-disposed plane of said track plate; and a plurality of secondary coils disposed on said running member.

3. The racing game apparatus as set forth in claim 2, wherein said primary coils are disposed in parallel along the running-member-disposed plane.

4. The racing game apparatus as set forth in claim 3, wherein one of two adjacent coils of said primary coils receives an alternate current opposite in phase to an alternate current received by the other of the adjacent coils from an alternate current source through a phase control circuit.

5. The racing game apparatus as set forth in claim 4, wherein each of said secondary coils has a first coil, a second coil, and a third coil, the first and second coils being wound around axes of first and second magnetic conductors, respectively, perpendicular to each other and in parallel with the running-member-disposed plane, the third coil being wound around ends of the first and second magnetic conductors and along the running-member-disposed plane.

6. The racing game apparatus as set forth in claim 3, wherein each of said secondary coils has a first coil, a second coil, and a third coil, the first and second coils being wound around axes of first and second magnetic conductors, respectively, perpendicular to each other and in parallel with the running-member-disposed plane, the third coil being wound around ends of the first and second magnetic conductors and along the running-member-disposed plane.

7. The racing game apparatus as set forth in claim 2, wherein each of said secondary coils has a first coil, a second coil, and a third coil, the first and second coils being wound around axes of first and second magnetic conductors, respectively, perpendicular to each other and in parallel with the running-member-disposed plane, the third coil being wound around ends of the first and second magnetic conductors and along the running-member-disposed plane.

8. The racing game apparatus as set forth in claim 1, wherein said arithmetic control circuit is adapted to receive control information from a controller through radio communication means.

9. The racing game apparatus as set forth in claim 8, wherein said radio communication means comprises:

information receiving means disposed on said running member and connected to said arithmetic control circuit; and information transmitting means disposed above said track plate and adjacent to a peripheral portion thereof.

10. The racing game apparatus as set forth in claim 9, wherein said information receiving means is a light receiving device and said information transmitting means is a light emitting device.

11. The racing game apparatus as set forth in claim 10, wherein a surface plate is disposed above said track plate with a space, said model being disposed on the surface plate so as to be moved by a magnet disposed at least on one of said running member and said model in association with said running member, the space formed by said track plate and the surface plate being closed by a side wall of the peripheral portion, the light emitting device being disposed between said running member and the surface plate.

* * * * *